US011542124B2

(12) United States Patent
Pahlke

(10) Patent No.: US 11,542,124 B2
(45) Date of Patent: Jan. 3, 2023

(54) SENSOR FUSION DOOR STATUS DETECTION

(71) Applicant: OTIS ELEVATOR COMPANY, Farmington, CT (US)

(72) Inventor: Derk Oscar Pahlke, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 905 days.

(21) Appl. No.: 16/410,021

(22) Filed: May 13, 2019

(65) Prior Publication Data

US 2020/0361749 A1 Nov. 19, 2020

(51) Int. Cl.
*B66B 13/14* (2006.01)
*B66B 3/00* (2006.01)
*B66B 5/00* (2006.01)

(52) U.S. Cl.
CPC ..... *B66B 13/14* (2013.01); *B66B 3/00* (2013.01); *B66B 5/0018* (2013.01)

(58) Field of Classification Search
CPC ... B66B 1/3492; B66B 5/0018; B66B 5/0037; B66B 1/24; B66B 5/0031; B66B 13/26; B66B 3/00; B66B 11/02; B66B 1/00; B66B 5/0006; B66B 13/14
See application file for complete search history.

(56) References Cited

U.S. PATENT DOCUMENTS

2002/0121984 A1* 9/2002 Tsukamoto ..... B66B 1/468 340/692
2017/0355554 A1* 12/2017 Eleid ..... B66B 1/2458
2020/0239270 A1* 7/2020 Witczak ..... B66B 5/0037
2020/0247643 A1* 8/2020 Witczak ..... B66B 5/0031
2020/0339385 A1* 10/2020 Michaelidis ..... B66B 5/0037
2020/0361749 A1* 11/2020 Pahlke ..... B66B 5/0025

FOREIGN PATENT DOCUMENTS

CN 102712445 A * 10/2012 ..... B66B 5/021
CN 103328365 B * 8/2015 ..... B66B 1/461
CN 105668356 A * 6/2016

(Continued)

OTHER PUBLICATIONS

Author Unknown, "Results Report", LIKOS Lift Explorer, Likos Lift Kontroll System, Jun. 2, 2014, 16 Pages.

(Continued)

*Primary Examiner* — Marlon T Fletcher
(74) *Attorney, Agent, or Firm* — Cantor Colburn LLP

(57) ABSTRACT

A method of monitoring a door of an elevator car within an elevator system including: detecting a first plurality of accelerations along an X-axis of the elevator system during a first time period; detecting a second plurality of accelerations along a Y-axis of the elevator system during the first time period; determining an absolute value of the first plurality of accelerations; determining an absolute value of the second plurality of accelerations; determining a first summation of the absolute value of the first plurality of accelerations and the absolute value of the second plurality of accelerations; and determining whether the door of the elevator car is in motion during the first time period by determining whether a maximum value of the first summation is greater than a threshold value.

19 Claims, 5 Drawing Sheets

(56) References Cited

FOREIGN PATENT DOCUMENTS

| | | | | | |
|---|---|---|---|---|---|
| CN | 106586752 | A | * | 4/2017 | |
| CN | 107337041 | A | * | 11/2017 | ..... B66B 5/0018 |
| CN | 108609449 | A | * | 10/2018 | ..... B66B 5/0031 |
| CN | 108689271 | A | * | 10/2018 | ..... B66B 5/0025 |
| CN | 106586752 | A | | 1/2019 | |
| CN | 109415182 | A | * | 3/2019 | ..... B66B 3/00 |
| CN | 113184651 | A | * | 7/2021 | |
| DE | 202008002642 | U1 | * | 6/2008 | ..... B66B 1/34 |
| EP | 1353868 | A1 | | 10/2003 | |
| JP | 2017178551 | A | * | 10/2017 | ..... B66B 1/14 |
| KR | 101444187 | B1 | * | 5/2013 | |
| KR | 20170136804 | A | * | 6/2016 | |
| WO | 2007020322 | A1 | | 2/2007 | |
| WO | WO-2009150251 | A2 | * | 12/2009 | ..... B66B 13/143 |
| WO | WO2018158813 | A1 | * | 2/2017 | |
| WO | WO-2018229128 | A1 | * | 12/2018 | ..... B66B 1/461 |
| WO | WO-2019130589 | A1 | * | 7/2019 | ..... B66B 11/02 |
| WO | WO-2021075006 | A1 | * | 4/2021 | |
| WO | WO-2021075008 | A1 | * | 4/2021 | |

OTHER PUBLICATIONS

Chinese Office Action for Application No. 202010396491.1; dated Jun. 17, 2021; 12 Pages.

European Search Report for Application No. 20165503.2; dated Nov. 13, 2020; 9 Pages.

* cited by examiner

SENSOR FUSION DOOR STATUS DETECTION

BACKGROUND

The embodiments herein relate to the field of conveyance systems, and specifically to a method and apparatus for monitoring a position of a conveyance apparatus of a conveyance system.

A precise position or status of a conveyance apparatus within a conveyance systems, such as, for example, elevator systems, escalator systems, and moving walkways may be difficult and/or costly to determine.

BRIEF SUMMARY

According to an embodiment, a method of monitoring a door of an elevator car within an elevator system is provided. The method including: detecting a first plurality of accelerations along an X-axis of the elevator system during a first time period; detecting a second plurality of accelerations along a Y-axis of the elevator system during the first time period; determining an absolute value of the first plurality of accelerations; determining an absolute value of the second plurality of accelerations; determining a first summation of the absolute value of the first plurality of accelerations and the absolute value of the second plurality of accelerations; and determining whether the door of the elevator car is in motion during the first time period by determining whether a maximum value of the first summation is greater than a threshold value.

In addition to one or more of the features described herein, or as an alternative, further embodiments may include: adjusting the threshold value if the maximum value of the first summation is less than a selected value.

In addition to one or more of the features described herein, or as an alternative, further embodiments may include: detecting a third plurality of accelerations along an X-axis of the elevator system during a second time period; detecting a fourth plurality of accelerations along a Y-axis of the elevator system during the second time period; determining an absolute value of the third plurality of accelerations; determining an absolute value of the fourth plurality of accelerations; determining a second summation of the absolute value of the third plurality of accelerations and the absolute value of the fourth plurality of accelerations; and determining whether the door of the elevator car is in motion during the second time period by determining whether a maximum value of the second summation is greater than the threshold value.

In addition to one or more of the features described herein, or as an alternative, further embodiments may include: determining that the door of the elevator car is in motion during the first time period and the second time period; determining that the second time period occurs at greater than threshold time period after the first time period; and determining that the door was in a reversal motion during the first time period.

In addition to one or more of the features described herein, or as an alternative, further embodiments may include: determining that the door of the elevator car is in motion during the first time period and the second time period; determining that the second time period occurs at less than threshold time period after the first time period; determining that the door was in an opening motion during the first time period; and determining that the door was in a closing motion during the first time period.

In addition to one or more of the features described herein, or as an alternative, further embodiments may include: determining that the maximum value of the first summation is greater than a threshold value; and determining that a door of the elevator car is in motion during the first time period when the maximum value of the first summation is greater than a threshold value.

In addition to one or more of the features described herein, or as an alternative, further embodiments may include: determining that the maximum value of the first summation is not greater than a threshold value; and determining that a door of the elevator car is not in motion during the first time period when the maximum value of the first summation is not greater than a threshold value.

In addition to one or more of the features described herein, or as an alternative, further embodiments may include that the X-axis is perpendicular to a Z-axis of the elevator system, the Z-axis being parallel to a direction of travel of the elevator car.

In addition to one or more of the features described herein, or as an alternative, further embodiments may include that the Y-axis is perpendicular to the X-axis and the Z-axis of the elevator system.

According to another embodiment, a system for monitoring a door of an elevator car within an elevator system is provided. The system including: a processor; and a memory including computer-executable instructions that, when executed by the processor, cause the processor to perform operations. The operations including: detecting a first plurality of accelerations along an X-axis of the elevator system during a first time period; detecting a second plurality of accelerations along a Y-axis of the elevator system during the first time period; determining an absolute value of the first plurality of accelerations; determining an absolute value of the second plurality of accelerations; determining a first summation of the absolute value of the first plurality of accelerations and the absolute value of the second plurality of accelerations; and determining whether the door of the elevator car is in motion during the first time period by determining whether a maximum value of the first summation is greater than a threshold value.

In addition to one or more of the features described herein, or as an alternative, further embodiments may include that the operations further include: adjusting the threshold value if the maximum value of the first summation is less than a selected value.

In addition to one or more of the features described herein, or as an alternative, further embodiments may include that the operations further include: detecting a third plurality of accelerations along an X-axis of the elevator system during a second time period; detecting a fourth plurality of accelerations along a Y-axis of the elevator system during the second time period; determining an absolute value of the third plurality of accelerations; determining an absolute value of the fourth plurality of accelerations; determining a second summation of the absolute value of the third plurality of accelerations and the absolute value of the fourth plurality of accelerations; and determining whether the door of the elevator car is in motion during the second time period by determining whether a maximum value of the second summation is greater than the threshold value.

In addition to one or more of the features described herein, or as an alternative, further embodiments may include that the operations further include: determining that the door of the elevator car is in motion during the first time period and the second time period; determining that the second time period occurs at greater than threshold time period after the first time period; and determining that the door was in a reversal motion during the first time period.

In addition to one or more of the features described herein, or as an alternative, further embodiments may include that the operations further include: determining that the door of the elevator car is in motion during the first time period and the second time period; determining that the second time period occurs at less than threshold time period after the first time period; determining that the door was in an opening motion during the first time period; and determining that the door was in a closing motion during the first time period.

In addition to one or more of the features described herein, or as an alternative, further embodiments may include that the operations further include: determining that the maximum value of the first summation is greater than a threshold value; and determining that a door of the elevator car is in motion during the first time period when the maximum value of the first summation is greater than a threshold value.

In addition to one or more of the features described herein, or as an alternative, further embodiments may include that the operations further include: determining that the maximum value of the first summation is not greater than a threshold value; and determining that a door of the elevator car is not in motion during the first time period when the maximum value of the first summation is not greater than a threshold value.

In addition to one or more of the features described herein, or as an alternative, further embodiments may include that the X-axis is perpendicular to a Z-axis of the elevator system, the Z-axis being parallel to a direction of travel of the elevator car.

In addition to one or more of the features described herein, or as an alternative, further embodiments may include that the Y-axis is perpendicular to the X-axis and the Z-axis of the elevator system.

According to another embodiment, a computer program product embodied on a non-transitory computer readable medium is provided. The computer program product including instructions that, when executed by a processor, cause the processor to perform operations including: detecting a first plurality of accelerations along an X-axis of the elevator system during a first time period; detecting a second plurality of accelerations along a Y-axis of the elevator system during the first time period; determining an absolute value of the first plurality of accelerations; determining an absolute value of the second plurality of accelerations; determining a first summation of the absolute value of the first plurality of accelerations and the absolute value of the second plurality of accelerations; and determining whether the door of the elevator car is in motion during the first time period by determining whether a maximum value of the first summation is greater than a threshold value.

Technical effects of embodiments of the present disclosure include detecting accelerations of a door and determining movement of the door in response to the accelerations.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
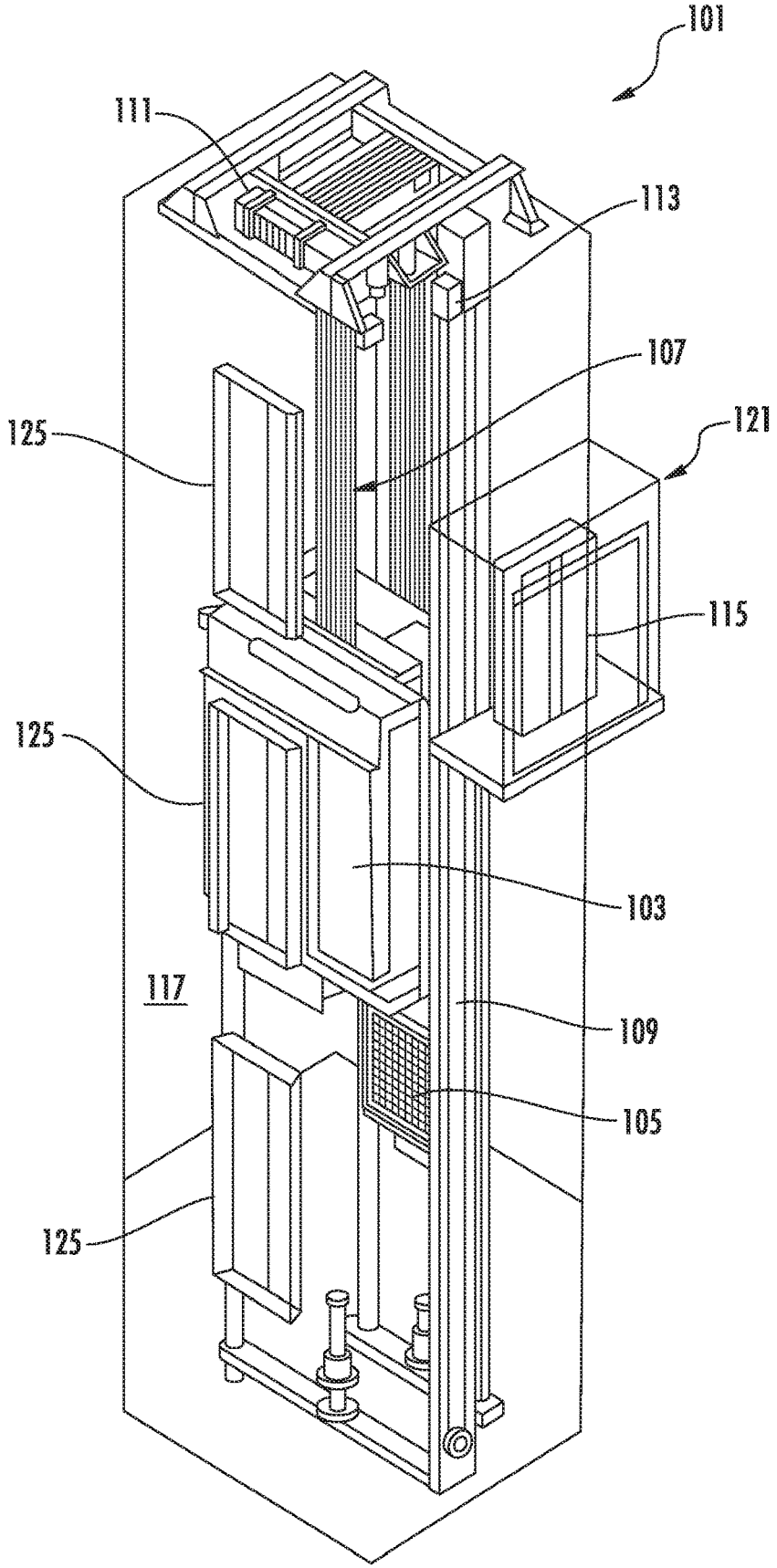
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1. In one example, embodiments disclosed herein may be applicable conveyance systems such as an elevator system 101 and a conveyance apparatus of the conveyance system such as an elevator car 103 of the elevator system 101. In another example, embodiments disclosed herein may be applicable conveyance systems such as an escalator system and a conveyance apparatus of the conveyance system such as a moving stair of the escalator system.

Figures 2, 3:
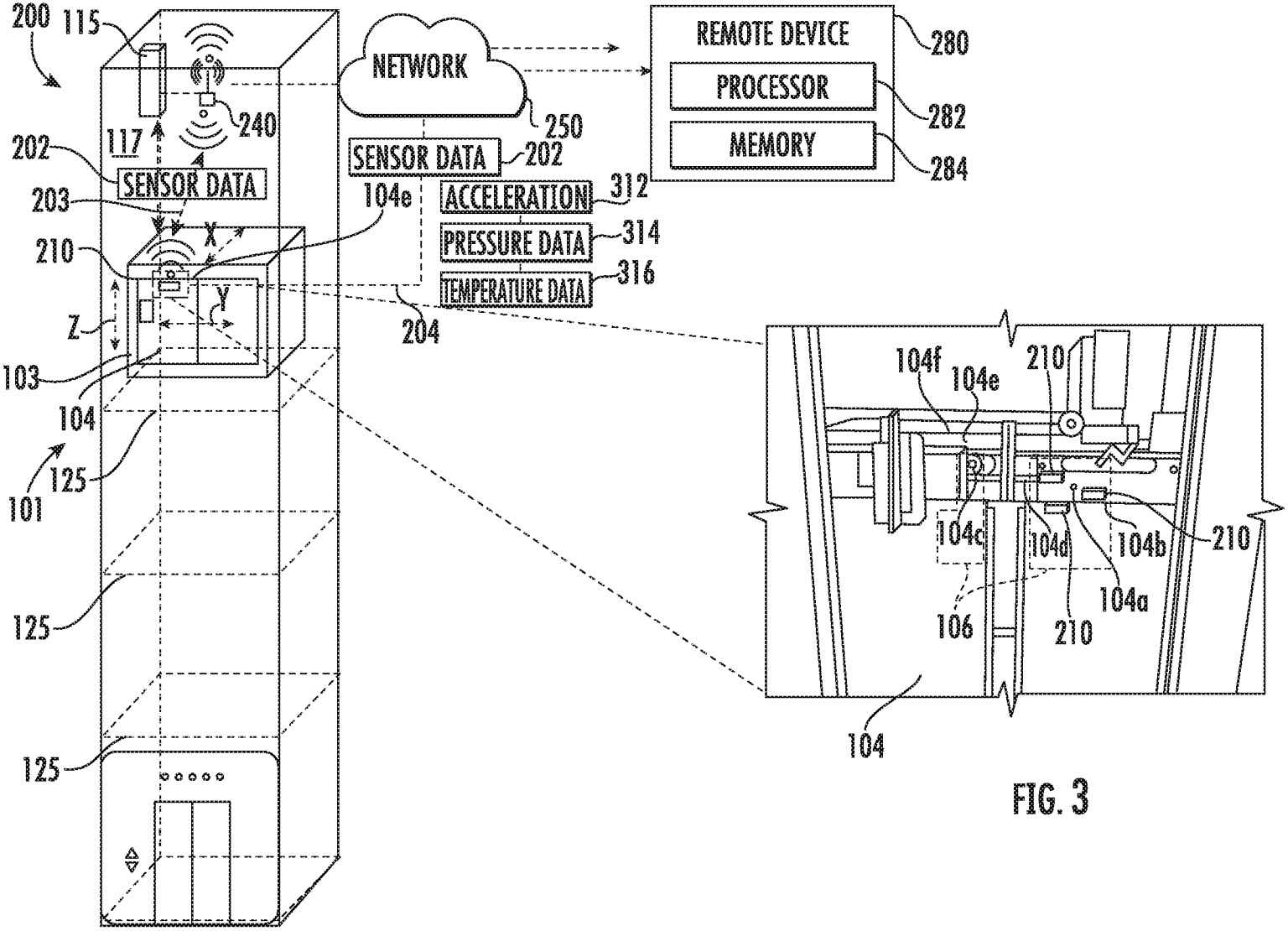
FIG. 2 is a schematic illustration of a sensor system for the elevator system of FIG. 1, in accordance with an embodiment of the disclosure.
FIG. 3 is a schematic illustration of the location of sensing apparatus of the sensor system of FIG. 2, in accordance with an embodiment of the disclosure.

Referring now to FIG. 2, with continued referenced to FIG. 1, a view of a sensor system 200 including a sensing apparatus 210 is illustrated, according to an embodiment of the present disclosure. The sensing apparatus 210 is configured to detect sensor data 202 of the elevator car 103 and transmit the sensor data 202 to a remote device 280. Sensor data 202 may include but is not limited to pressure data 314, vibratory signatures (i.e., vibrations over a period of time) or accelerations 312 and derivatives or integrals of accelerations 312 of the elevator car 103, such as, for example, distance, velocity, jerk, jounce, snap . . . etc. Sensor data 202 may also include light, sound, humidity, and temperature, or any other desired data parameter. The pressure data 314 may include atmospheric air pressure within the elevator shaft 117. It should be appreciated that, although particular systems are separately defined in the schematic block diagrams, each or any of the systems may be otherwise combined or separated via hardware and/or software. For example, the sensing apparatus 210 may be a single sensor or may be multiple separate sensors that are interconnected.

In an embodiment, the sensing apparatus 210 is configured to transmit sensor data 202 that is raw and unprocessed to the controller 115 of the elevator system 101 for processing. In another embodiment, the sensing apparatus 210 is configured to process the sensor data 202 prior to transmitting the sensor data 202 to the controller 115 through a processing method, such as, for example, edge processing. In another embodiment, the sensing apparatus 210 is configured to transmit sensor data 202 that is raw and unprocessed to a remote system 280 for processing. In yet another embodiment, the sensing apparatus 210 is configured to process the sensor data 202 prior to transmitting the sensor data 202 to the remote device 280 through a processing method, such as, for example, edge processing.

The processing of the sensor data 202 may reveal data, such as, for example, a number of elevator door openings/closings, elevator door time, vibrations, vibratory signatures, a number of elevator rides, elevator ride performance, elevator flight time, probable car position (e.g. elevation, floor number), releveling events, rollbacks, elevator car 103 x, y acceleration at a position: (i.e., rail topology), elevator car 103 x, y vibration signatures at a position: (i.e., rail topology), door performance at a landing number, nudging event, vandalism events, emergency stops, etc.

The remote device 280 may be a computing device, such as, for example, a desktop, a cloud based computer, and/or a cloud based artificial intelligence (AI) computing system. The remote device 280 may also be a mobile computing device that is typically carried by a person, such as, for example a smartphone, PDA, smartwatch, tablet, laptop, etc. The remote device 280 may also be two separate devices that are synced together, such as, for example, a cellular phone and a desktop computer synced over an internet connection.

The remote device 280 may be an electronic controller including a processor 282 and an associated memory 284 comprising computer-executable instructions that, when executed by the processor 282, cause the processor 282 to perform various operations. The processor 282 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 284 may be but is not limited to a random access memory (RAM), read only memory (ROM), or other electronic, optical, magnetic or any other computer readable medium.

The sensing apparatus 210 is configured to transmit the sensor data 202 to the controller 115 or the remote device 280 via short-range wireless protocols 203 and/or long-range wireless protocols 204. Short-range wireless protocols 203 may include but are not limited to Bluetooth, Wi-Fi, HaLow (801.11ah), zWave, ZigBee, or Wireless M-Bus. Using short-range wireless protocols 203, the sensing apparatus 210 is configured to transmit the sensor data 202 to directly to the controller 115 or to a local gateway device 240 and the local gateway device 240 is configured to transmit the sensor data 202 to the remote device 280 through a network 250 or to the controller 115. The network 250 may be a computing network, such as, for example, a cloud computing network, cellular network, or any other computing network known to one of skill in the art. Using long-range wireless protocols 204, the sensing apparatus 210 is configured to transmit the sensor data 202 to the remote device 280 through a network 250. Long-range wireless protocols 204 may include but are not limited to cellular, satellite, LTE (NB-IoT, CAT M1), LoRa, Satellite, Ingenu, or SigFox.

The sensing apparatus 210 may be configured to detect sensor data 202 including acceleration in any number of directions. In an embodiment, the sensing apparatus may detect sensor data 202 including accelerations 312 along three axis, an X-axis, a Y-axis, and a Z-axis, as show in in FIG. 2. The X-axis may be perpendicular to the doors 104 of the elevator car 103, as shown in FIG. 2. The Y-axis may be parallel to the doors 104 of the elevator car 103, as shown in FIG. 2. The Z-axis may be aligned vertically parallel with the elevator shaft 117, the direction of travel of the elevator car 103, and pull of gravity, as shown in FIG. 2. The acceleration data 312 may reveal vibratory signatures generated along the X-axis, the Y-axis, and the Z-axis. The X-axis is perpendicular to the Y-axis and the Z-axis. The Y-axis is perpendicular to the X-axis and the Z-axis. The Z-axis is perpendicular to the X-axis and the Y-axis.

FIG. 3 shows a possible installation location of the sensing apparatus 210 within the elevator system 101. The sensing apparatus 210 may include a magnet (not show) to removably attach to the elevator car 103. In the illustrated embodiment shown in FIG. 3, the sensing apparatus 210 may be installed on the door hanger 104*a* and/or the door 104 of the elevator system 101. It is understood that the sensing apparatus 210 may also be installed in other locations other than the door hanger 104*a* and the door 104 of the elevator system 101. It is also understood that multiple sensing apparatus 210 are illustrated in FIG. 3 to show various locations of the sensing apparatus 210 and the embodiments disclosed herein may include one or more sensing apparatus 210. In another embodiment, the sensing apparatus 210 may be attached to a door header 104*e* of a door 104 of the elevator car 103. In another embodiment, the sensing apparatus 210 may be located on a door header 104*e* proximate a top portion 104*f* of the elevator car 103. In another embodiment, the sensing apparatus 210 is installed elsewhere on the elevator car 103, such as, for example, directly on the door 104.

As shown in FIG. 3, the sensing apparatus 201 may be located on the elevator car 103 in the selected areas 106, as shown in FIG. 3. The doors 104 are operably connected to the door header 104*e* through a door hanger 104*a* located proximate a top portion 104*b* of the door 104. The door hanger 104*a* includes guide wheels 104*c* that allow the door 104 to slide open and close along a guide rail 104*d* on the door header 104*e*. Advantageously, the door hanger 104*a* is an easy to access area to attach the sensing apparatus 210 because the door hanger 104*a* is accessible when the elevator car 103 is at landing 125 and the elevator door 104 is open. Thus, installation of the sensing apparatus 210 is possible without taking special measures to take control over the elevator car 103. For example, the additional safety of an emergency door stop to hold the elevator door 104 open is not necessary as door 104 opening at landing 125 is a normal operation mode. The door hanger 104*a* also provides ample clearance for the sensing apparatus 210 during operation of the elevator car 103, such as, for example, door 104 opening and closing. Due to the mounting location of the sensing apparatus 210 on the door hanger 104*a*, the sensing apparatus 210 may detect open and close motions (i.e., acceleration) of the door 104 of the elevator car 103 and a door at the landing 125. Additionally mounting the sensing apparatus 210 on the hanger 104*a* allows for recording of a ride quality of the elevator car 103.

Figure 4:
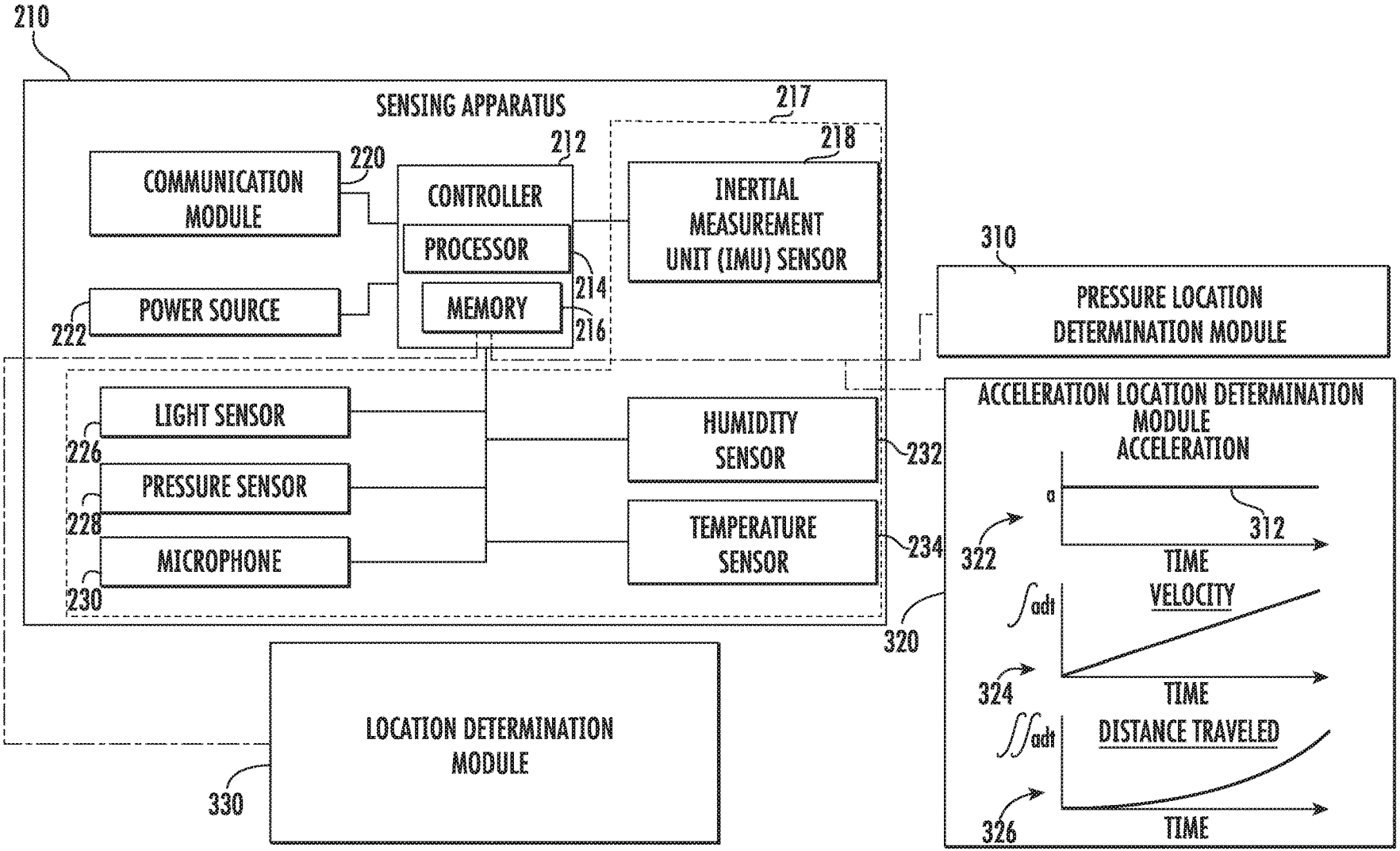
FIG. 4 is a schematic illustration of a sensing apparatus of the sensor system of FIG. 2, in accordance with an embodiment of the disclosure.

FIG. 4 illustrates a block diagram of the sensing apparatus 210 of the sensing system of FIGS. 2 and 3. It should be appreciated that, although particular systems are separately defined in the schematic block diagram of FIG. 4, each or any of the systems may be otherwise combined or separated via hardware and/or software. As shown in FIG. 4, the sensing apparatus 210 may include a controller 212, a plurality of sensors 217 in communication with the controller 212, a communication module 220 in communication with the controller 212, and a power source 222 electrically connected to the controller 212.

The plurality of sensors 217 includes an inertial measurement unit (IMU) sensor 218 configured to detect sensor data 202 including accelerations 312 of the sensing apparatus 210 and the elevator car 103 when the sensing apparatus 210 is attached to the elevator car 103. The IMU sensor 218 may be a sensor, such as, for example, an accelerometer, a gyroscope, or a similar sensor known to one of skill in the art. The accelerations 312 detected by the IMU sensor 218 may include accelerations 312 as well as derivatives or integrals of accelerations, such as, for example, velocity, jerk, jounce, snap . . . etc. The IMU sensor 218 is in communication with the controller 212 of the sensing apparatus 210.

The plurality of sensors 217 includes a pressure sensor 228 is configured to detect sensor data 202 including pressure data 314, such as, for example, atmospheric air pressure within the elevator shaft 117. The pressure sensor 228 may be a pressure altimeter or barometric altimeter in two non-limiting examples. The pressure sensor 228 is in communication with the controller 212.

The plurality of sensors 217 may also include additional sensors including but not limited to a light sensor 226, a pressure sensor 228, a microphone 230, a humidity sensor 232, and a temperature sensor 234. The light sensor 226 is configured to detect sensor data 202 including light exposure. The light sensor 226 is in communication with the controller 212. The microphone 230 is configured to detect sensor data 202 including audible sound and sound levels. The microphone 230 is in communication with the controller 212. The humidity sensor 232 is configured to detect sensor data 202 including humidity levels. The humidity sensor 232 is in communication with the controller 212. The temperature sensor 234 is configured to detect sensor data 202 including temperature levels. The temperature sensor 234 is in communication with the controller 212.

The controller 212 of the sensing apparatus 210 includes a processor 214 and an associated memory 216 comprising computer-executable instructions that, when executed by the processor 214, cause the processor 214 to perform various operations, such as, for example, edge pre-processing or processing the sensor data 202 collected by the IMU sensor 218, the light sensor 226, the pressure sensor 228, the microphone 230, the humidity sensor 232, and the temperature sensor 234. In an embodiment, the controller 212 may process the accelerations 312 and/or the pressure data 314 in order to determine a probable location of the elevator car 103, discussed further below. The processor 214 may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 216 may be a storage device, such as, for example, a random access memory (RAM), read only memory (ROM), or other electronic, optical, magnetic or any other computer readable medium.

The power source 222 of the sensing apparatus 210 is configured to store and supply electrical power to the sensing apparatus 210. The power source 222 may include an energy storage system, such as, for example, a battery system, capacitor, or other energy storage system known to one of skill in the art. The power source 222 may also generate electrical power for the sensing apparatus 210. The power source 222 may also include an energy generation or electricity harvesting system, such as, for example synchronous generator, induction generator, or other type of electrical generator known to one of skill in the art.

The sensing apparatus 210 includes a communication module 220 configured to allow the controller 212 of the sensing apparatus 210 to communicate with the remote device 280 and/or controller 115 through at least one of short-range wireless protocols 203 and long-range wireless protocols 204. The communication module 220 may be configured to communicate with the remote device 280 using short-range wireless protocols 203, such as, for example, Bluetooth, Wi-Fi, HaLow (801.11ah), Wireless M-Bus, zWave, ZigBee, or other short-range wireless protocol known to one of skill in the art. Using short-range wireless protocols 203, the communication module 220 is configured to transmit the sensor data 202 to a local gateway device 240 and the local gateway device 240 is configured to transmit the sensor data 202 to a remote device 280 through a network 250, as described above. The communication module 220 may be configured to communicate with the remote device 280 using long-range wireless protocols 204, such as for example, cellular, LTE (NB-IoT, CAT M1), LoRa, Ingenu, SigFox, Satellite, or other long-range wireless protocol known to one of skill in the art. Using long-range wireless protocols 204, the communication module 220 is configured to transmit the sensor data 202 to a remote device 280 through a network 250. In an embodiment, the short-range wireless protocol 203 is sub GHz Wireless M-Bus. In another embodiment, the long-range wireless protocol is SigFox. In another embodiment, the long-range wireless protocol is LTE NB-IoT or CAT M1 with 2G fallback.

The sensing apparatus 210 includes a location determination module 330 configured to determine a location (i.e., position) of the elevator car 103 within the elevator shaft 117. The location of the elevator car 103 may be fixed locations along the elevator shaft 117, such as for example, the landings 125 of the elevator shaft 117. The locations may be equidistantly spaced apart along the elevator shaft 117 such as, for example, 5 meters or any other selected distance. Alternatively, the locations may be or intermittently spaced apart along the elevator shaft 117.

The location determination module 330 may utilize various approaches to determine a location of the elevator car 103 within the elevator shaft 117. The location determination module 330 may be configured to determine a location of the elevator car 103 within the elevator shaft 117 using at least one of a pressure location determination module 310 and an acceleration location determination module 320.

The acceleration location determination module 320 is configured to determine a distance traveled of the elevator car 103 within the elevator shaft 117 in response to the acceleration of the elevator car 103 detected along the Y axis. The sensing apparatus 210 may detect an acceleration along the Y axis shown at 322 and may integrate the acceleration to get a velocity of the elevator car 103 at 324. At 326, the sensing apparatus 210 may also integrate the velocity of the elevator car 103 to determine a distance traveled by the elevator car 103 within the elevator shaft 117 during the acceleration 312 detected at 322. The direction of travel of the elevator car 103 may also be determined in response to the acceleration 312 detected. The location determination module 330 may then determine the location of the elevator car 103 within the elevator shaft 117 in response to a starting location and a distance traveled away from that starting location. The starting location may be based upon tracking the past operation and/or movement of the elevator car 103.

The pressure location determination module 310 is configured to detect an atmospheric air pressure within the elevator shaft 117 when the elevator car 103 is in motion and/or stationary using the pressure sensor 228. The pressure detected by the pressure sensor 228 may be associated with a location (e.g., height, elevation) within the elevator shaft 117 through either a look up table or a calculation of altitude using the barometric pressure change in two non-limiting embodiments. The direction of travel of the elevator car 103 may also be determined in response to the change in pressure detected via the pressure data 314. The pressure sensor 228 may need to periodically detect a baseline pressure to account for changes in atmospheric pressure due to local weather conditions. For example, this baseline pressure may need to be detected daily, hourly, or weekly in non-limiting embodiments. In some embodiments, the baseline pressure may be detected whenever the elevator car 103 is stationary, or at certain intervals when the elevator car 103 is stationary and/or at a known location. The acceleration of the elevator car 103 may also need to be detected to know when the elevator car 103 is stationary and then when the elevator car 103 is stationary the sensing apparatus 210 may need to be offset to compensate the sensor drift and environment drift.

In one embodiment, the pressure location determination module 310 may be used to verify and/or modify a location of the elevator car 102 within the elevator shaft 117 determined by the acceleration location determination module 320. In another embodiment, the acceleration location determination module 320 may be used to verify and/or modify a location of the elevator car 102 within the elevator shaft 117 determined by the pressure location determination module 310. In another embodiment, the pressure location determination module 310 may be prompted to determine a location of the elevator car 103 within the elevator shaft 117 in response to an acceleration detected by the IMU sensor 218.

Figure 5:
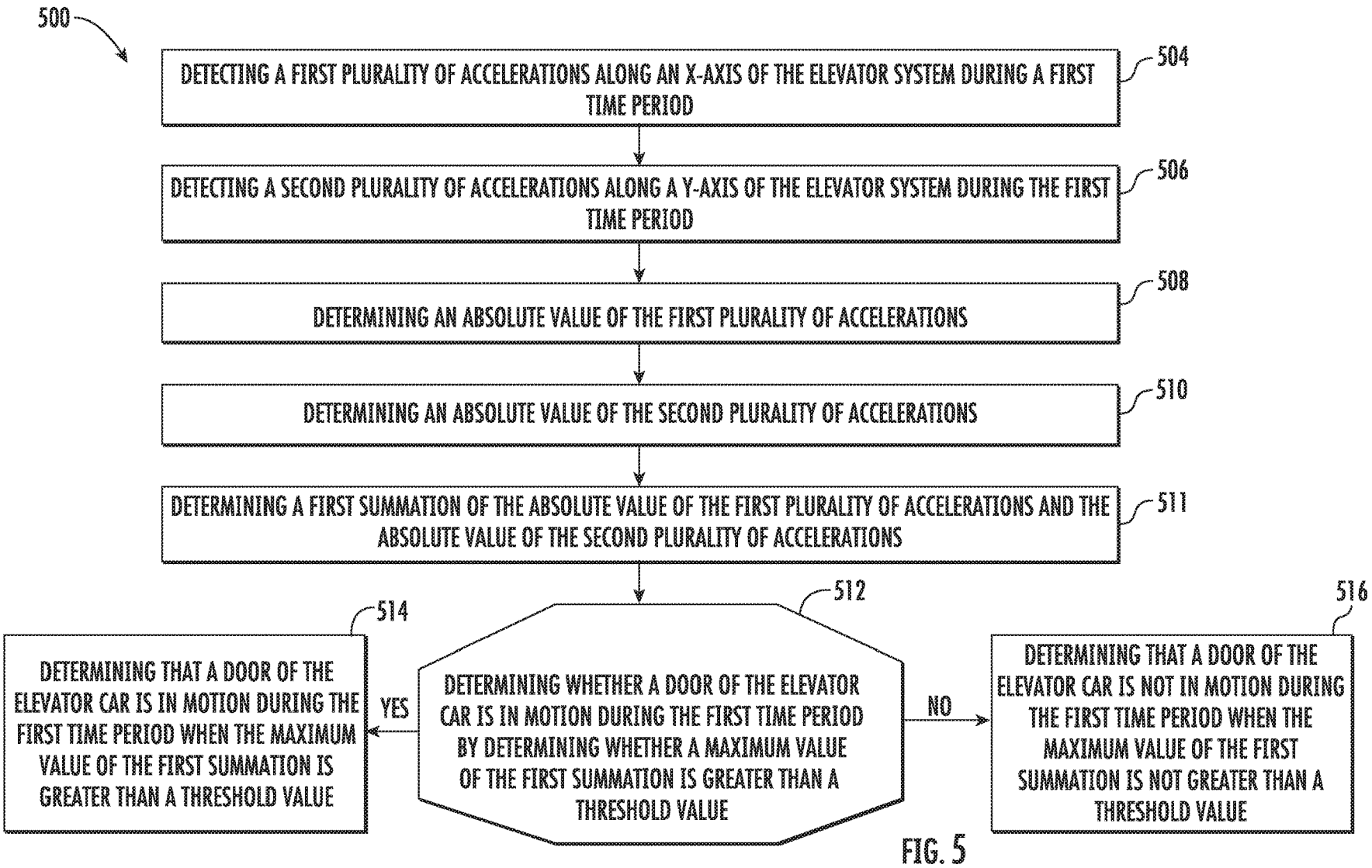
FIG. 5 is a flow chart of a method of monitoring a direction of motion a conveyance apparatus within a conveyance system, in accordance with an embodiment of the disclosure.
Figure 6:
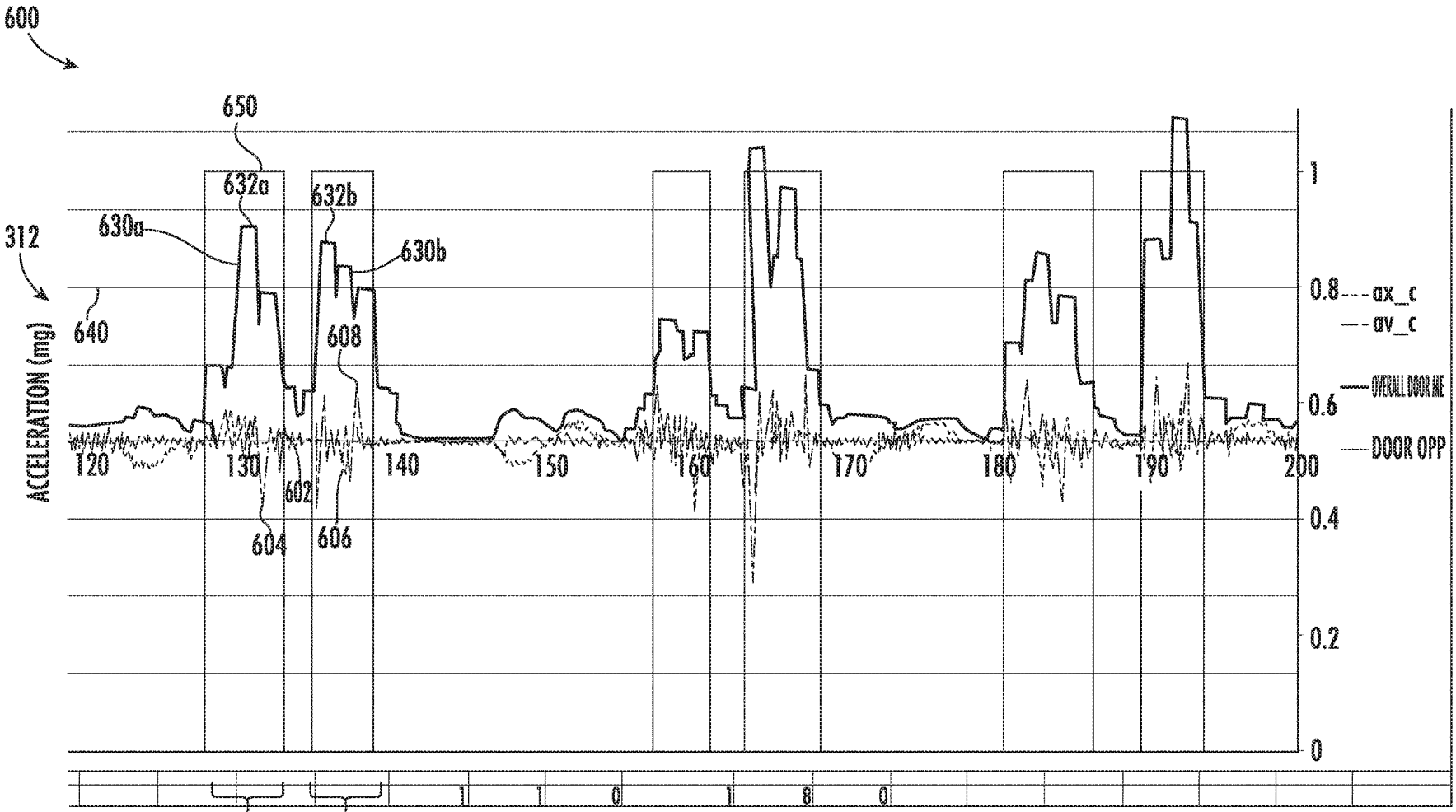
FIG. 6 is a chart illustrating analysis of detected accelerations of the elevator system over time, in accordance with an embodiment of the disclosure.

Referring now to FIGS. 5 and 6, while referencing components of FIGS. 1-4. FIG. 5 shows a flow chart of a method 500 of monitoring a door 104 of an elevator car 103 within an elevator system 101, in accordance with an embodiment of the disclosure. In an embodiment, the method 500 may be performed by at least one of the sensing apparatus 210, the controller 115, and the remote device 280. FIG. 6 illustrates analysis of detected accelerations 312 of the elevator system 101 over time 601 within a chart 600.

At block 504, a first plurality of accelerations 602 is detected along an X-axis of the elevator system 101 during a first time period 610. In an embodiment, X-axis is perpendicular to a Z-axis of the elevator system 101 and the Z-axis is parallel to a direction of travel of the elevator car 103. At block 506, a second plurality of accelerations 604 is along a Y-axis of the elevator system 101 during the first time period 610. In an embodiment, the Y-axis is perpendicular to the X-axis and the Z-axis of the elevator system 101.

At block 508, an absolute value of the first plurality of accelerations is determined. At block 510, an absolute value of the second plurality of accelerations 604 is determined.

At block 511, the absolute value of the first plurality of accelerations 602 is combined with the absolute value of the second plurality of accelerations 604 and a first summation 630*a* determined. The first summation 630*a* of the absolute value of the first plurality of accelerations 602 and the absolute value of the second plurality of accelerations 604 may be visible on the chart 600 illustrated in FIG. 6.

At block 512, it is determined whether a door 104 of the elevator car 103 is in motion during the first time period 610 by determining whether a maximum value 632*a* of the first summation 630*a* is greater than a threshold value 640.

At block 512, the method 500 may utilize equation (i):

$$\text{IF MAX}[t_2\text{-}t_1](\text{ABS}(\text{acc}_{x(t)}))+(\text{ABS}(\text{acc}_{y(t)}))>\text{Threshold Value THEN door movement=TRUE} \quad \text{(i)}$$

Where the $t_2$-$t_1$ is the first time period 610, MAX[$t_2$-$t_1$] is the maximum value during the first time period 610 of the first summation 630*a* of (ABS($\text{acc}_{x(t)}$))+(ABS($\text{acc}_{y(t)}$)), ABS ($\text{acc}_{x(t)}$) is the absolute value of the first plurality of accelerations 602 along the X-axis during the first time period 610, ABS($\text{acc}_{y(t)}$) is the absolute value of the second plurality of accelerations 604 along the Y-axis during the first time period 610.

If at block 512 it is determined that the maximum value 632*a* of the first summation 630*a* is greater than a threshold value 640 then at block 514 it is determined that the door 104 of the elevator car 103 is in motion during the first time period when the maximum value 632*a* of the first summation 630*a* is greater than a threshold value 640. Equation i may generate a square function 650 at a value of one when the elevator door 104 is confirmed to be moving.

If at block 512 it is determined that the maximum value 632*a* of the first summation 630*a* is not greater than a threshold value 640 then at block 514 it is determined that the door 104 of the elevator car 103 is not in motion during the first time period when the maximum value 632*a* of the first summation 630*a* is not greater than a threshold value 640.

The method 500 may further include adjusting the threshold value 640 if the maximum value 632*a* of the first summation 630*a* is less than a selected value, which may be represented by equation ii.

$$\text{IF MAX}[t_2\text{-}t_1](\text{ABS}(\text{acc}_{x(t)}))+(\text{ABS}(\text{acc}_{y(t)}))<\text{Selected Value THEN Threshold value=X}_1$$

$$\text{ELSE Threshold value=X}_2\text{*(MAX}[t_2\text{-}t_1](\text{ABS}(\text{acc}_{x(t)}))+(\text{ABS}(\text{acc}_{y(t)})) \quad \text{(ii)}$$

Where X1 is a first variable and X2 is a second variable. The first variable is a base value, which allows detection of door movement for doors 104 with low vibrations or accelerations 312 (e.g. center opening doors). To ensure edge computing on the sensing apparatus 210 is ready to detect door 104 movements with higher accelerations 312 then the threshold value needs to be adjusted, which may be accomplished by measuring the max acceleration values during door 104 movement and adjusting the threshold accordingly with the second variable. In an embodiment, the first variable X1 may be equivalent to less than 300 mg. In an embodiment, the second variable may be equivalent to about (20+7/30).

The method 500 may further include: detecting a third plurality of accelerations 606 along an X-axis of the elevator system 101 during a second time period 620 and detecting a fourth plurality of accelerations 608 along a Y-axis of the elevator system 101 during the second time period 620. The method 500 may also include that an absolute value of the third plurality of accelerations 606 and an absolute value of the fourth plurality of accelerations 608 are determined.

A second summation 630*b* may be determined. The second summation 630*b* is the summation of the absolute value of the third plurality of accelerations 606 and the absolute value of the fourth plurality of accelerations 608 may be visible on the chart 600 illustrated in FIG. 6.

It may then be determined whether the door 104 of the elevator car 103 is in motion during the second time period 620 by determining whether a maximum value 632*b* of the second summation 630*b* is greater than a threshold value 640, which may utilize equation iii $$\text{IF MAX}[t_4\text{-}t_3](\text{ABS}(\text{acc}_{x(t)}))+(\text{ABS}(\text{acc}_{y(t)}))>\text{Threshold Value THEN door movement=TRUE} \quad \text{(i)}$$

Where the $t_4$-$t_3$ is the second time period 620, MAX[$t_2$-$t_1$] is the maximum value 632*b* during the first time period 610 of the second summation 630*b* of (ABS($\text{acc}_{x(t)}$))+(ABS($\text{acc}_{y(t)}$)), ABS($\text{acc}_{x(t)}$) is the absolute value of the third plurality of accelerations 606 along the X-axis during the second time period 620, ABS($\text{acc}_{y(t)}$) is the absolute value of the fourth plurality of accelerations 608 along the Y-axis during the second time period 620.

If it is determined that the door 104 of the elevator car 103 is in motion during the first time period 610 and the second time period 620 and that the second time period 620 occurs at greater than threshold time period after the first time period 610 then it may be determined that the door was in a reversal motion during the first time period 610. For example, if the door motion is detected during the first time period 610 but then door motion is not detected moving until the next day during the second time period 620 then it may be determined that the door motion during the first time period 610 and the second time period 620 are not connected 9 (e.g., not an opening and closing pair)

If it is determined that the door 104 of the elevator car 103 is in motion during the first time period 610 and the second time period 620 and that the second time period 620 occurs at less than a threshold time period after the first time period 610 then it may be determined that the door 103 was in an opening motion during the first time period 610 and the door 104 was in a closing motion during the second time period 620. For example, if the door motion is detected moving during the first time period 610 and then a short time later door motion is detected during the second time period then it may be determined that the motion during the first time period 610 and the second time period 620 are connected and the door motion during the first time period 610 may be an opening motion of the door 104 and the door motion during the second time period 620 may be a closing motion of the door 104 complimenting the opening motion.

While the above description has described the flow process of FIG. 5 in a particular order, it should be appreciated that unless otherwise specifically required in the attached claims that the ordering of the steps may be varied.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of monitoring a door of an elevator car within an elevator system, the method comprising:

detecting a first plurality of accelerations along an X-axis of the elevator system during a first time period;

detecting a second plurality of accelerations along a Y-axis of the elevator system during the first time period;

determining an absolute value of the first plurality of accelerations;

determining an absolute value of the second plurality of accelerations;

determining a first summation of the absolute value of the first plurality of accelerations and the absolute value of the second plurality of accelerations; and determining whether the door of the elevator car is in motion during the first time period by determining whether a maximum value of the first summation is greater than a threshold value.

2. The method of claim 1, further comprising:

adjusting the threshold value if the maximum value of the first summation is less than a selected value.

3. The method of claim 1, further comprising:

detecting a third plurality of accelerations along an X-axis of the elevator system during a second time period;

detecting a fourth plurality of accelerations along a Y-axis of the elevator system during the second time period;

determining an absolute value of the third plurality of accelerations;

determining an absolute value of the fourth plurality of accelerations;

determining a second summation of the absolute value of the third plurality of accelerations and the absolute value of the fourth plurality of accelerations; and determining whether the door of the elevator car is in motion during the second time period by determining whether a maximum value of the second summation is greater than the threshold value.

4. The method of claim 3, further comprising:

determining that the door of the elevator car is in motion during the first time period and the second time period;

determining that the second time period occurs at greater than threshold time period after the first time period; and determining that the door was in a reversal motion during the first time period.

5. The method of claim 3, further comprising:

determining that the door of the elevator car is in motion during the first time period and the second time period;

determining that the second time period occurs at less than threshold time period after the first time period;

determining that the door was in an opening motion during the first time period; and determining that the door was in a closing motion during the first time period.

6. The method of claim 1, further comprising:

determining that the maximum value of the first summation is greater than a threshold value; and determining that a door of the elevator car is in motion during the first time period when the maximum value of the first summation is greater than a threshold value.

7. The method of claim 1, further comprising:

determining that the maximum value of the first summation is not greater than a threshold value; and determining that a door of the elevator car is not in motion during the first time period when the maximum value of the first summation is not greater than a threshold value.

8. The method of claim 1, wherein the X-axis is perpendicular to a Z-axis of the elevator system, the Z-axis being parallel to a direction of travel of the elevator car.

9. The method of claim 8, wherein the Y-axis is perpendicular to the X-axis and the Z-axis of the elevator system.

10. A system for monitoring a door of an elevator car within an elevator system, the system comprising:

a processor; and a memory comprising computer-executable instructions that, when executed by the processor, cause the processor to perform operations, the operations comprising:

detecting a first plurality of accelerations along an X-axis of the elevator system during a first time period;

detecting a second plurality of accelerations along a Y-axis of the elevator system during the first time period;

determining an absolute value of the first plurality of accelerations;

determining an absolute value of the second plurality of accelerations;

determining a first summation of the absolute value of the first plurality of accelerations and the absolute value of the second plurality of accelerations; and determining whether the door of the elevator car is in motion during the first time period by determining whether a maximum value of the first summation is greater than a threshold value.

11. The system of claim 10, wherein the operations further comprise:

adjusting the threshold value if the maximum value of the first summation is less than a selected value.

12. The system of claim 10, wherein the operations further comprise:

detecting a third plurality of accelerations along an X-axis of the elevator system during a second time period;

detecting a fourth plurality of accelerations along a Y-axis of the elevator system during the second time period;

determining an absolute value of the third plurality of accelerations;

determining an absolute value of the fourth plurality of accelerations;

determining a second summation of the absolute value of the third plurality of accelerations and the absolute value of the fourth plurality of accelerations; and determining whether the door of the elevator car is in motion during the second time period by determining whether a maximum value of the second summation is greater than the threshold value.

13. The system of claim 12, wherein the operations further comprise:

determining that the door of the elevator car is in motion during the first time period and the second time period;

determining that the second time period occurs at greater than threshold time period after the first time period; and determining that the door was in a reversal motion during the first time period.

14. The system of claim 12, wherein the operations further comprise:

determining that the door of the elevator car is in motion during the first time period and the second time period;

determining that the second time period occurs at less than threshold time period after the first time period;

determining that the door was in an opening motion during the first time period; and determining that the door was in a closing motion during the first time period.

15. The system of claim 10, wherein the operations further comprise:

determining that the maximum value of the first summation is greater than a threshold value; and determining that a door of the elevator car is in motion during the first time period when the maximum value of the first summation is greater than a threshold value.

16. The system of claim 10, wherein the operations further comprise:

determining that the maximum value of the first summation is not greater than a threshold value; and determining that a door of the elevator car is not in motion during the first time period when the maximum value of the first summation is not greater than a threshold value.

17. The system of claim 10, wherein the X-axis is perpendicular to a Z-axis of the elevator system, the Z-axis being parallel to a direction of travel of the elevator car.

18. The system of claim 17, wherein the Y-axis is perpendicular to the X-axis and the Z-axis of the elevator system.

19. A computer program product embodied on a non-transitory computer readable medium, the computer program product including instructions that, when executed by a processor, cause the processor to perform operations comprising:

detecting a first plurality of accelerations along an X-axis of the elevator system during a first time period;

detecting a second plurality of accelerations along a Y-axis of the elevator system during the first time period;

determining an absolute value of the first plurality of accelerations;

determining an absolute value of the second plurality of accelerations;

determining a first summation of the absolute value of the first plurality of accelerations and the absolute value of the second plurality of accelerations; and determining whether the door of the elevator car is in motion during the first time period by determining whether a maximum value of the first summation is greater than a threshold value.

* * * * *